US009339925B2

(12) United States Patent
Liu et al.

(10) Patent No.: US 9,339,925 B2
(45) Date of Patent: May 17, 2016

(54) FASTENER DRIVING DEVICE WITH DUST BLOWER

(75) Inventors: Jim Liu, Dali (TW); Sean Lee, Dali (TW); Benson Liao, Dali (TW)

(73) Assignee: STANLEY FASTENING SYSTEMS, L.P., Greenwich, RI (US)

( * ) Notice: Subject to any disclaimer, the term of this patent is extended or adjusted under 35 U.S.C. 154(b) by 1023 days.

(21) Appl. No.: 12/829,226

(22) Filed: Jul. 1, 2010

(65) Prior Publication Data

US 2012/0000031 A1 Jan. 5, 2012

(51) Int. Cl.
*B25C 1/08* (2006.01)
*B25F 5/00* (2006.01)

(52) U.S. Cl.
CPC .... *B25F 5/00* (2013.01); *B25C 1/08* (2013.01)

(58) Field of Classification Search
CPC ..... B25C 1/08
USPC ..... 227/8, 112, 120, 130; 173/168, 169
See application file for complete search history.

(56) References Cited

U.S. PATENT DOCUMENTS 3,515,225 A * 6/1970 States ..... 173/176
4,854,393 A * 8/1989 Palet ..... 173/62
4,870,755 A * 10/1989 Schnizler ..... 30/123.3
5,878,936 A 3/1999 Adachi et al. ..... 227/130
6,783,050 B2 8/2004 Ishizawa et al. ..... 227/130
6,892,459 B2 * 5/2005 Okumura et al. ..... 30/123.3
7,175,065 B2 2/2007 Wey ..... 227/130
7,322,505 B2 1/2008 Ishizawa et al. ..... 227/130
7,438,207 B2 10/2008 Wu et al. ..... 227/130
2001/0004084 A1 * 6/2001 Hirai et al. ..... 227/130
2004/0026477 A1 * 2/2004 Ishizawa et al. ..... 227/130
2006/0131042 A1 * 6/2006 Hammerstingl et al. ..... 173/201
2008/0023518 A1 1/2008 Wojcicki ..... 227/130
2008/0087704 A1 4/2008 Wen ..... 227/130

* cited by examiner

*Primary Examiner* — Nathaniel Chukwurah
(74) *Attorney, Agent, or Firm* — Pillsbury Winthrop Shaw Pittman LLP

(57) ABSTRACT

A fastener driving device includes a housing having an engine receiving portion and a handle portion. A reservoir is configured to receive a gas having a pressure greater than atmospheric pressure and is at least partially located in the handle portion. A dust blower is configured to allow gas in the reservoir to be selectively communicated to atmosphere through an outlet in the engine receiving portion of the housing. The dust blower includes a passageway extending from the reservoir to the outlet in the engine receiving portion, the passageway at least partially circumnavigating the cylinder of the drive engine, and an actuator configured to selectively open and close the passageway so that when the passageway is open, gas from the reservoir is communicated from the reservoir to the outlet, and when the passageway is closed, the gas from the reservoir is not communicated from the reservoir to the outlet.

9 Claims, 9 Drawing Sheets

FASTENER DRIVING DEVICE WITH DUST BLOWER

FIELD

The present invention is related to a fastener driving device that includes a dust blower.

BACKGROUND

Fastener driving devices are often used in a construction setting in which dust may cover the target location for a fastener. This may make it challenging to accurately locate where a fastener is to be driven into the workpiece. In order to clean off the target location, the user of the fastener driving device may hold the fastener driving device with one hand, and use the other hand to manipulate a separate blower or brush.

Although there is at least one existing fastener driving device that has a built-in dust blower located near the head valve of the device, it takes two hands to use the dust blower, one hand to hold the device and one hand to operate the dust blower. Moreover, the outlet of the dust blower is located towards an upper portion of the device, which makes it awkward to use when needed.

SUMMARY

It is desirable to have a fastener driving device with a built-in dust blower that is less cumbersome to use.

According to one aspect of the invention, there is provided a fastener driving device that includes a housing having an engine receiving portion and a handle portion. A drive engine is located in the engine receiving portion. The drive engine includes a cylinder and a piston reciprocally mounted within the cylinder. The piston includes a driver configured to move along a drive axis to drive a fastener during a drive stroke. A reservoir is at least partially located in the handle portion and is configured to receive a gas having a pressure greater than atmospheric pressure. The reservoir is in fluid communication with the drive engine. The fastener driving device also includes a trigger configured to operate the drive engine, and a dust blower configured to allow gas in the reservoir to be selectively communicated to atmosphere through an outlet in the engine receiving portion of the housing. The dust blower includes a passageway extending from the reservoir to the outlet in the engine receiving portion of the housing. The passageway at least partially circumnavigates the cylinder of the drive engine. The dust blower also includes an actuator configured to selectively open and close the passageway so that when the passageway is open, gas from the reservoir is communicated from the reservoir to the outlet, and when the passageway is closed, the gas from the reservoir is not communicated from the reservoir to the outlet.

According to another aspect of the invention, there is provided a fastener driving device that includes a housing having an engine receiving portion and a handle portion extending from the engine receiving portion. A nose assembly is operatively connected to the housing and defines a drive track. A drive engine located in the engine receiving portion of the housing, and includes a cylinder and a piston reciprocally mounted within the cylinder. The piston includes a driver configured to move along a drive axis to drive a fastener out of the drive track in the nose assembly during a drive stroke. A reservoir is at least partially located in the handle portion and is configured to receive a gas having a pressure greater than atmospheric pressure. The reservoir is in fluid communication with the drive engine. The fastener driving device includes a trigger configured to operate the drive engine. A dust blower is configured to allow gas in the reservoir to be selectively communicated to atmosphere through an outlet in the engine receiving portion of the housing. The outlet is positioned near the nose assembly and configured to direct at least a portion of the gas generally in the same direction as the drive axis.

According to another aspect of the invention, there is provided a fastener driving device that includes a housing having an engine receiving portion and a handle portion. A drive engine is located in the engine receiving portion, and includes a cylinder and a piston reciprocally mounted within the cylinder. The piston includes a driver configured to move along a drive axis to drive a fastener during a drive stroke. A reservoir is at least partially located in the handle portion and is configured to receive a gas having a pressure greater than atmospheric pressure. The reservoir is in fluid communication with the drive engine. The fastener driving device also includes a trigger configured to operate the drive engine. A dust blower is configured to allow gas in the reservoir to be selectively communicated to atmosphere through an outlet in the engine receiving portion of the housing. The dust blower includes an actuator on the housing. The actuator has a manually engageable portion positioned on or near the handle portion to enable a user grasping the handle portion with one hand to access the trigger and/or the manually engageable portion with the one-hand. The actuator is configured to selectively open and close a passageway between the reservoir and the outlet so that when the passageway is open, gas from the reservoir is communicated from the reservoir to the outlet, and when the passageway is closed, the gas from the reservoir is not communicated from the reservoir to the outlet.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

Features of the fastener driving device in accordance with one embodiment are shown in the drawings, in which like reference numerals designate like elements. The drawings form part of this original disclosure in which.

DETAILED DESCRIPTION

Figure 1:
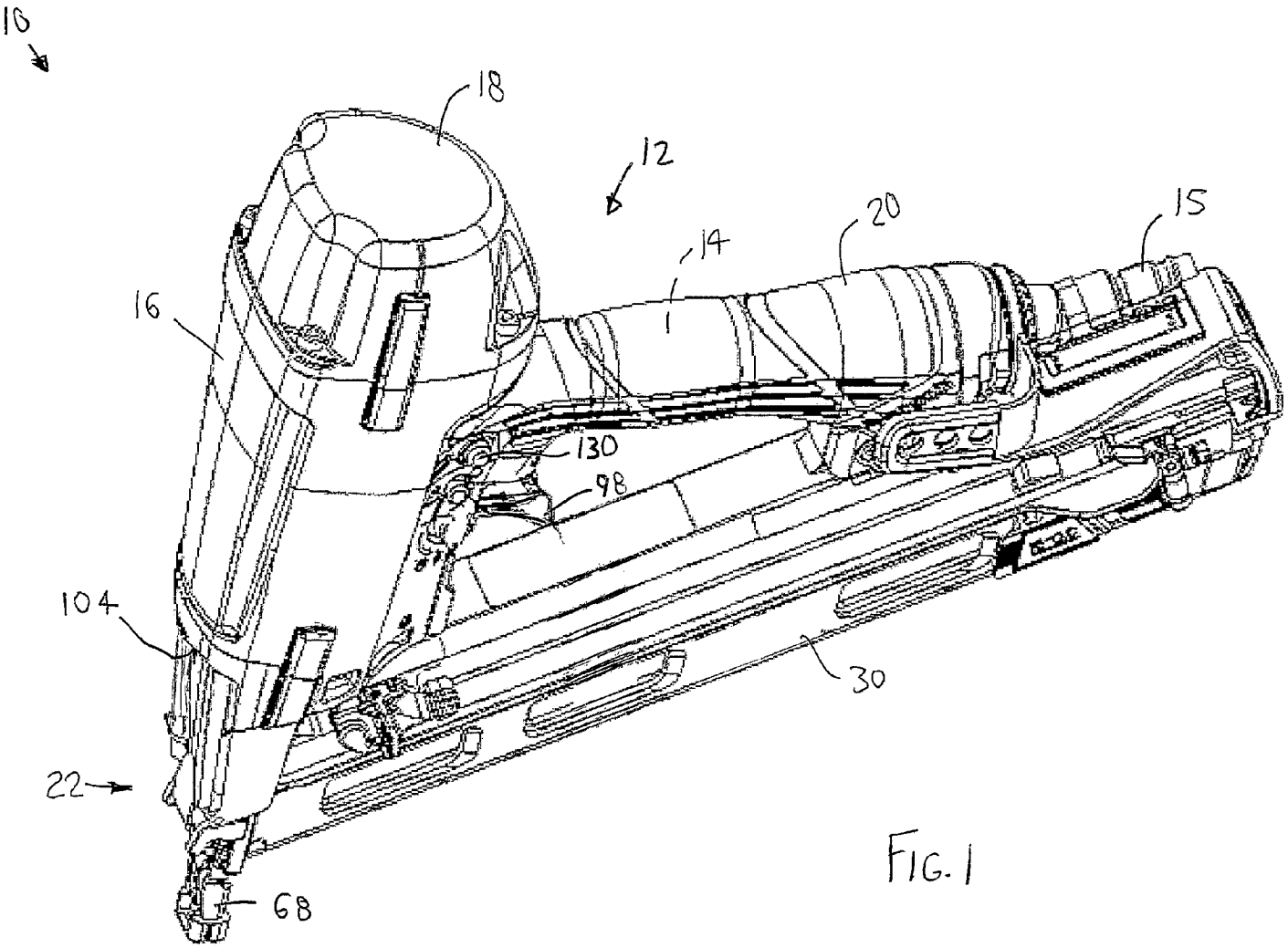
FIG. 1 illustrates a perspective view of a fastener driving device according to an embodiment of the invention.

FIG. 1 illustrates a fastener driving device 10 according to an embodiment of the invention. The device 10 includes a housing 12 that defines a reservoir 14 therein. The housing 12 may be constructed from a lightweight yet durable material, such as magnesium. The reservoir 14 is configured to receive a pressurized gas that is used to power the device 10. In an embodiment, the pressurized gas may be provided to the reservoir 14 from a compressor through a hose. The hose may be connected to the device 10 via a fitting 15 that may be attached to the housing 12, or the pressurized gas may be provided to the reservoir 14 through a cartridge. For example, the pressurized gas may be air that has been compressed by a compressor, as is commonly used in pneumatic tools. It is also contemplated that any gas that releases energy upon expansion, such as a gas produced as a by-product of combustion, or a gas that is produced upon a phase transformation of a liquid, such as carbon dioxide may also be used to power the device 10. The illustrated embodiment is not intended to be limiting in any way.

As illustrated, the housing 12 includes an engine receiving portion 16 and a cap 18 that is connected to the engine receiving portion 16 at one end. The housing 12 also includes a handle portion 20 that extends from the engine receiving portion 16. As shown, the handle portion 20 may extend substantially perpendicularly from the engine receiving portion 16. The handle portion 20 is configured to be received by a user's hand, thereby making the device 10 portable. The reservoir 14 is substantially defined by the handle portion 20, although it is contemplated that a portion of the reservoir 14 may be defined by the engine receiving portion 16 as well. In an embodiment, the handle portion 20 may also include a second reservoir (not shown) that is configured to be open to atmosphere and is configured to allow exhaust gas to exit the device 10 through the handle portion 20.

Figure 2:
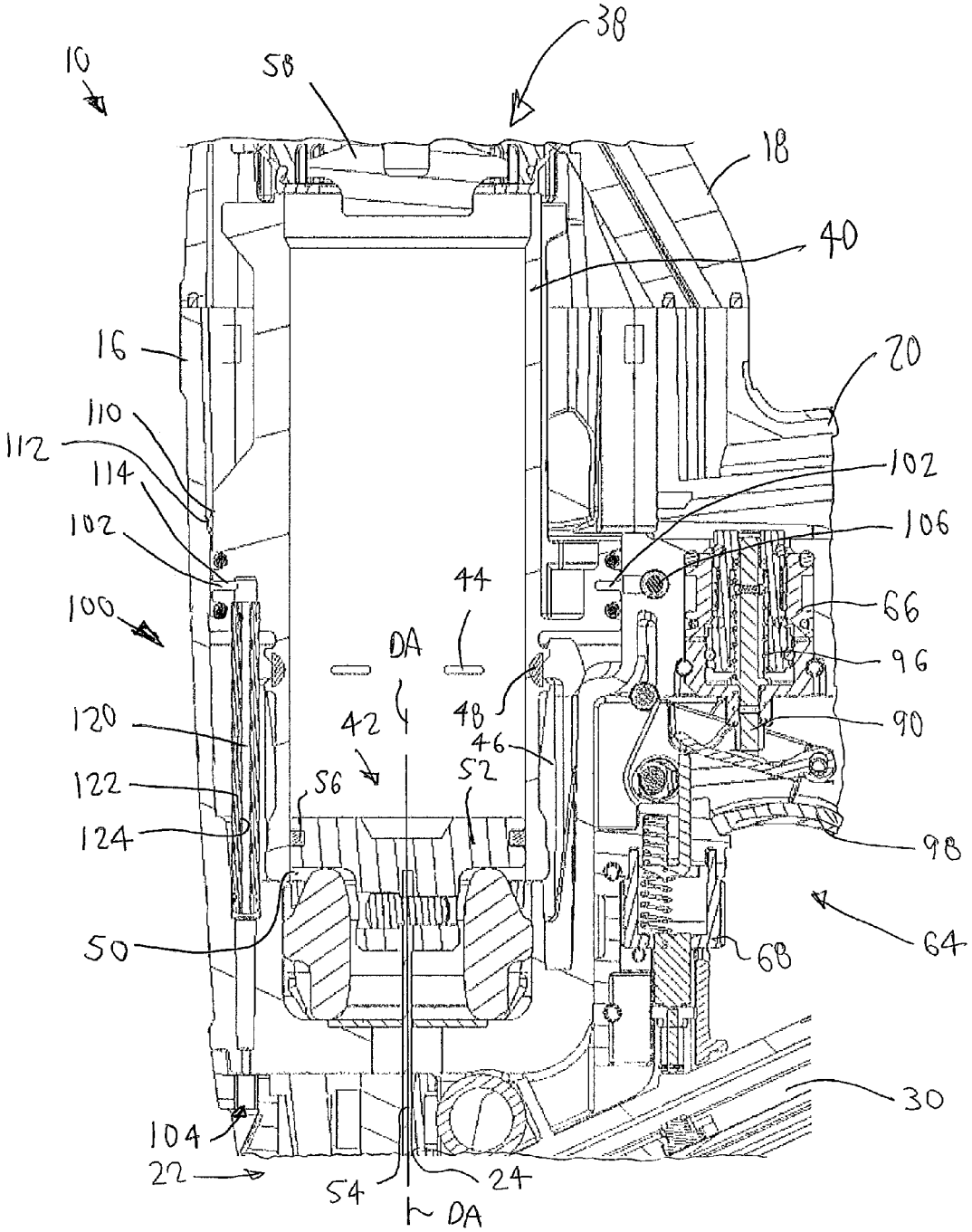
FIG. 2 illustrates a partial cross-sectional view of the fastener driving device of FIG. 1.

The device 10 also includes a nose assembly 22 that is connected to the housing 12. The nose assembly 22 defines a fastener drive track 24 therein, as illustrated in FIG. 2. A magazine assembly 30 is constructed and arranged to feed successive leading fasteners from a supply of fasteners contained therein along a feed track and into the drive track 24. The supply of fasteners is urged toward the drive track 24 with a pusher that is biased towards the drive track 24 and engages the last fastener in the supply of fasteners. Although the illustrated magazine assembly 30 is configured to receive fasteners that are collated in a stick configuration, it is also contemplated that a magazine assembly that is configured to accommodate fasteners that are collated in a coil may also be used. The illustrated embodiment is not intended to be limiting in any way.

As shown in FIG. 2, an engine 38 is disposed in the engine receiving portion 16 of the housing 12. The engine 38 includes a cylinder 40 and a fastener driver 42 that is movably mounted in the cylinder 40, and, hence, the housing 12. The cylinder 40 is oriented such that its longitudinal axis substantially aligns with a longitudinal axis of the drive track 24. The cylinder 40 includes a plurality of openings 44 that are arranged circumferentially around the cylinder 40 at an intermediate portion thereof. The openings 44 allow gas that is in the cylinder 40 to flow into a plenum 46 that is defined by an outside surface of the cylinder 40 and the housing 12. The openings 44 are provided with seals 48 that act as one-way valves such that gas may exit the cylinder 40 into the plenum 46, but gas in the plenum 46 may not enter the cylinder 40 through the openings 44. Instead, gas may enter the cylinder 40 through at least one opening 50 that is located towards one end of the cylinder 40 near the drive track 24, as shown in FIG. 2. Movement of gas in and out of the cylinder 40 will be discussed in greater detail below in connection with the operation of the device 10.

The fastener driver 42 is configured to enter the drive track 24 and drive the successive leading fasteners, one at a time, into the workpiece. The fastener driver 42 may have any configuration. In the illustrated embodiment, the fastener driver 42 includes a piston 52 and a drive rod 54 that is connected to the piston 52. A seal 56 is provided between the piston 52 and an interior wall of the cylinder 40 so as to form a slidable seal. This allows pressure on one side of the piston 52 to be different from pressure on the other side of the piston 52 so that a pressure differential may effect movement of the piston 52. The drive rod 54 may be connected to the piston 52 by any suitable fastening technique, such as a threaded or a welded connection. The illustrated embodiment is not intended to be limiting in any way. The drive rod 54 may have a substantially circular cross-section, or the drive rod 54 may have a cross-section that is D-shaped, or is shaped as a crescent, as would be understood by one of ordinary skill in the art.

The engine 38 also includes a head valve 58, partially shown in FIG. 2 that is disposed above the cylinder 40. The head valve 58 is constructed and arranged to substantially seal the top of the cylinder 40 from the reservoir 14 when the head valve 58 is in a closed position, and move away from the cylinder 40 when the head valve 58 is moved to an open position. A spring (not shown) is disposed between the head valve 58 and the cap 18 such that the head valve 58 is biased to the closed position when there is no pressurized gas in the device 10 or when the pressurized gas applies equal force on both sides of the head valve 58. The head valve 58 is constructed and arranged to be actuated so as to allow the pressurized gas that is in the reservoir 14 to enter the cylinder 40 and move the fastener driver 42 through an operating cycle. Each cycle includes a drive stroke in which the driver 42 moves along a drive axis DA and drives the leading fastener into the workpiece, and a return stroke in which the driver 42 is returned to its initial position so that it is ready for another drive stroke.

The device 10 also includes an actuator 64 that is constructed and arranged to actuate the head valve 58, and, hence, initiate the drive stroke. The actuator 64 includes a trigger valve 66 and a contact arm 68 that interacts with the trigger valve 66 through a mechanical linkage. The trigger valve 66 is constructed and arranged to allow passage of the pressurized gas from the reservoir 14 to a chamber above the head valve 58 through a passageway (not shown), and to selectively allow passage of gas from the chamber through an exhaust opening in the trigger valve 66.

The trigger valve 66 may be moved to the actuated position by pressing a valve stem 90 against the force applied on the valve stem 90 by the pressurized gas, and the bias of a spring 96 that is disposed within the trigger valve 66. This may be done with the user's finger, or can be done with a trigger 98 that is rotatably mounted to the housing 12. Triggers that have linear movement rather then rotational movement are also contemplated. When the trigger 98 is rotated toward the valve stem 90 while the contact arm 68 is depressed against the workpiece, the trigger 98 engages the valve stem 90 and presses the valve stem 90 against the bias of the spring 96. When the trigger valve 66 is actuated, i.e. when the valve stem 90 is moved against the bias of the spring 96 and the pressurized gas, the passageway within the trigger valve 66 between the chamber above the head valve 58 and the exhaust opening is opened, and the pressurized gas in the chamber is now able to flow through the trigger valve and out the exhaust opening.

Actuation of the head valve 58, or movement of the head valve 58 to the open position, will depend on whether the pressurized gas from the chamber above the head valve 58 is exhausted to atmosphere through the trigger valve 66. Once the pressurized gas from the chamber starts to be exhausted, the pressure within the chamber drops. This pressure drop, when high enough, allows the head valve 58 to move to the open position due to the force being exerted on the head valve 58 by the pressurized gas within the reservoir 14, which is at a greater pressure. Additional details of suitable engines and actuators for the fastener driving device 10 may be found in, for example, U.S. Pat. Nos. 7,134,586, 7,143,918, and 7,677,426, the entire contents which are incorporated herein by reference.

As illustrated in FIGS. 2-9, the fastener driving device 10 also includes a dust blower 100. The dust blower 100 is configured to allow pressurized gas in the reservoir 14 to be selectively communicated to atmosphere, as discussed in further detail below. In one embodiment, the dust blower 100 includes a passageway 102 that extends from the reservoir 14 to an outlet 104 in the engine receiving portion 16 of the housing 12, and an actuator 106 that is configured to selectively open and close the passageway 102. When the passageway 102 is open, gas in the reservoir 14 is communicated from the reservoir 14' to the outlet 104 through the actuator 106 and the passageway 102. When the passageway 102 is closed, the gas is not communicated from the reservoir 14 to the outlet 104.

Figure 5:
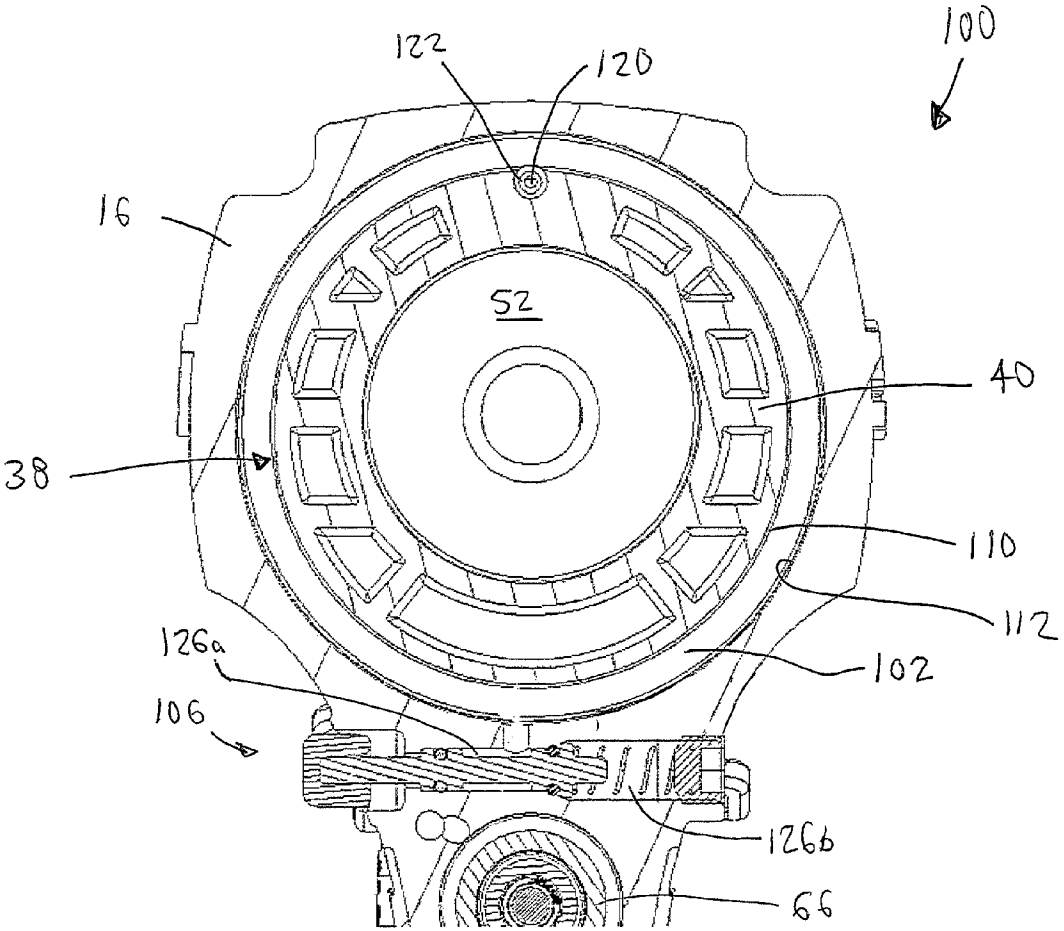
FIG. 5 illustrates a partial cross-sectional view of a portion of the dust blower of FIG. 4.

As illustrated in FIG. 5, the passageway 102 at least partially circumnavigates the cylinder 40 of the drive engine 38. The passageway 102 may be defined by a gap between an outer surface 110 of the cylinder 40 and an inner surface 112 of the engine receiving portion 16 of the housing 12. In the illustrated embodiment, the outer surface 110 of the cylinder 40 may define a recess 114 or groove (see FIG. 2) that partially defines the passageway 102. In an alternative embodiment (not shown), the inner surface 112 of the engine receiving portion 16 of the housing 12 may define a recess or groove that partially defines the passageway 102. The illustrated embodiment is not intended to be limiting in any way.

The passageway 102 is connected to the outlet 104 via a second passageway 120 that extends perpendicularly from the passageway 102 and substantially parallel to the longitudinal axis of the cylinder, as illustrated in FIG. 2. As illustrated, a tube 122 having an inner lumen 124 is placed between the cylinder 40 and the engine receiving portion 16 of the housing 12 to define the second passageway 120. The diameter of the inner lumen 124 may be sized so that second passageway 120 may amplify or reduce the pressure of the gas entering the second passageway 120 so that the desired pressure of gas is delivered to the outlet 104. In an embodiment, the second passageway 120 may be entirely defined by the engine receiving portion 16 of the housing 12, or may be entirely defined by the cylinder 40, or may be defined by various surfaces of the engine receiving portion 16 of the housing 12 and the cylinder 40 in a similar manner that the passageway 102 is defined. The illustrated embodiment is not intended to be limiting in any way.

Figure 3:
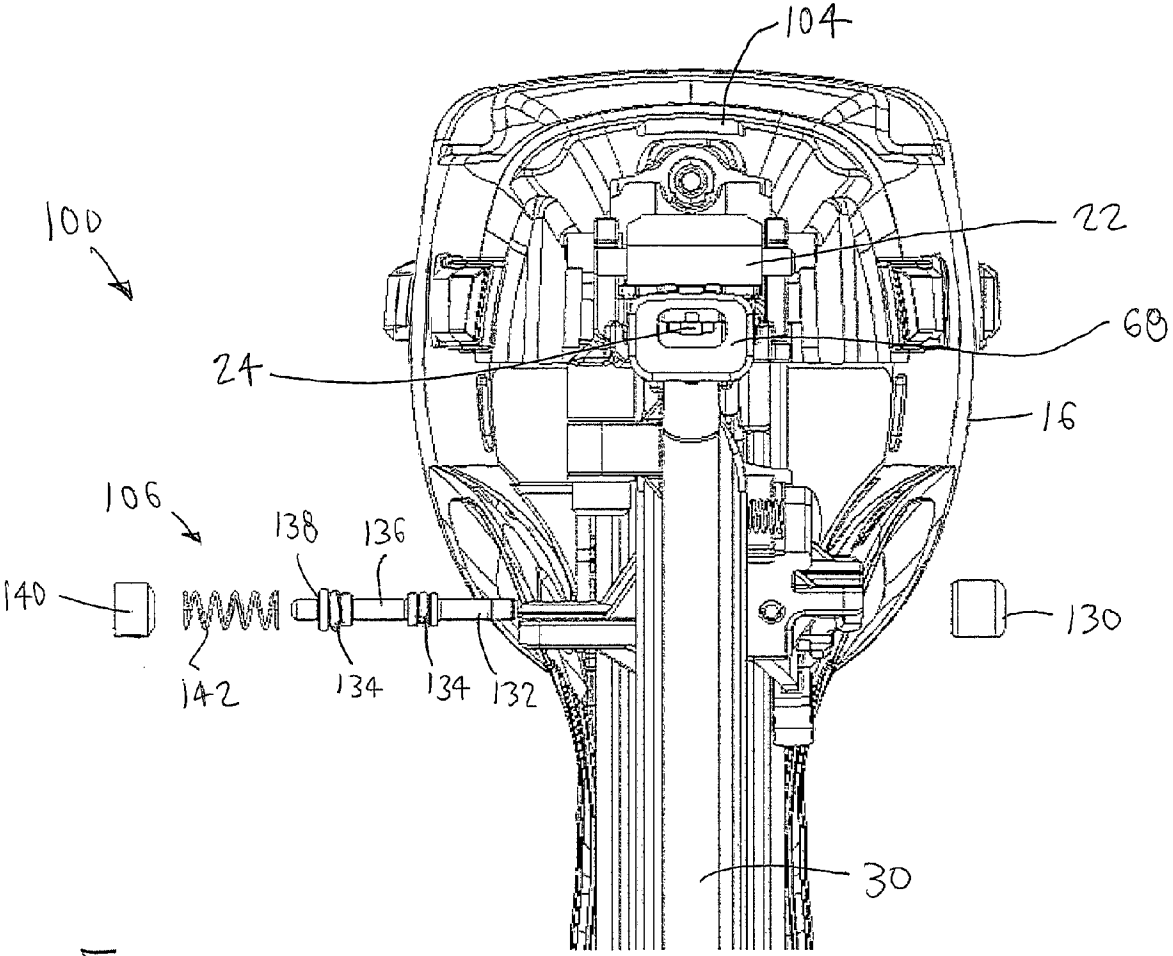
FIG. 3 illustrates a partial bottom view of the fastener driving device of FIG. 1 with an actuator of a dust blower in exploded view.
Figure 9:
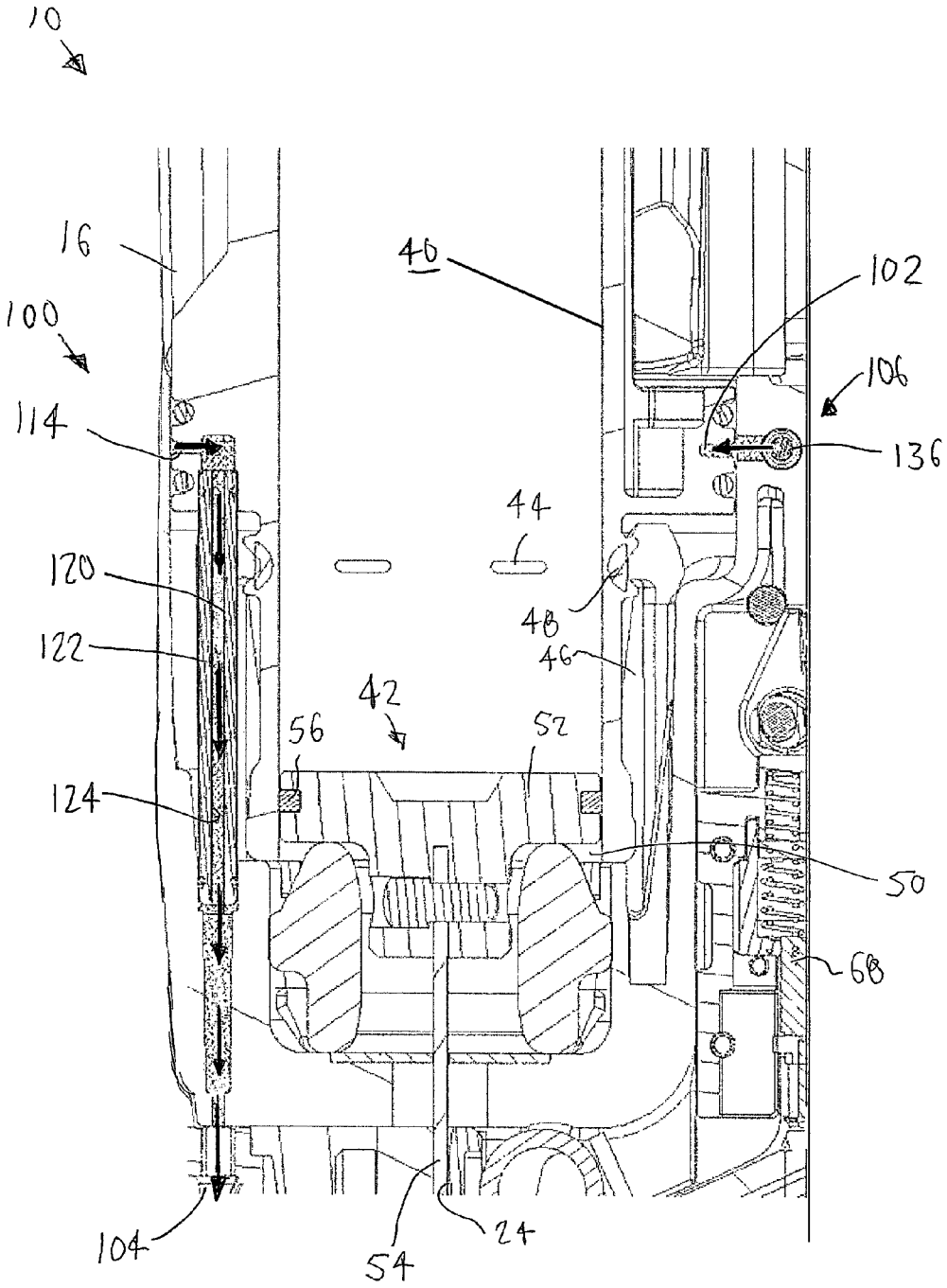
FIG. 9 illustrates the portion of the dust blower of FIG. 2 when the elongated member of the actuator is in the second position.

As can be appreciated from FIG. 9, the outlet 104 comprises an opening in the housing 12 positioned near the nose assembly 22. The outlet 104 is configured to direct at least a portion of the gas exiting the second passageway 120 generally in the same direction (e.g., from 0° to about 45° relative to the drive axis DA) that the fastener is driven out of the fastener driving device when the device is in use. The outlet 104 may have any suitable shape that allows the gas to exit the dust blower 100 in the desired direction and at the desired pressure. In the illustrated embodiment, the outlet 104 has an elongated shape that allows the flow of the gas to fan out across a width, as shown in FIG. 3. In an embodiment, the outlet 104 may have a circular shape that allows the flow of the gas to be more directed and concentrated than the flow of gas exiting an outlet having an elongated shape. In one embodiment, at least a portion of the gas is directed in a direction that is parallel to (i.e. at an angle of 0° relative to) the drive track axis. In another embodiment, the gas is directed generally at an angle of less that 30° relative to the drive track axis. In another embodiment, the gas may fan out at an angle; and in one embodiment, the included angle is 60° or less. In one embodiment, the included angle is 30° or less. In one embodiment; the included angle is bisected by a line that is generally parallel to the drive axis DA. The illustrated embodiment is not intended to be limiting in any way. For example, in an alternative embodiment, an adjustable nozzle may be positioned in the outlet 104 so that the precise direction of the pressurized gas that exits the outlet may be changed based on the user's preference.

Figure 4:
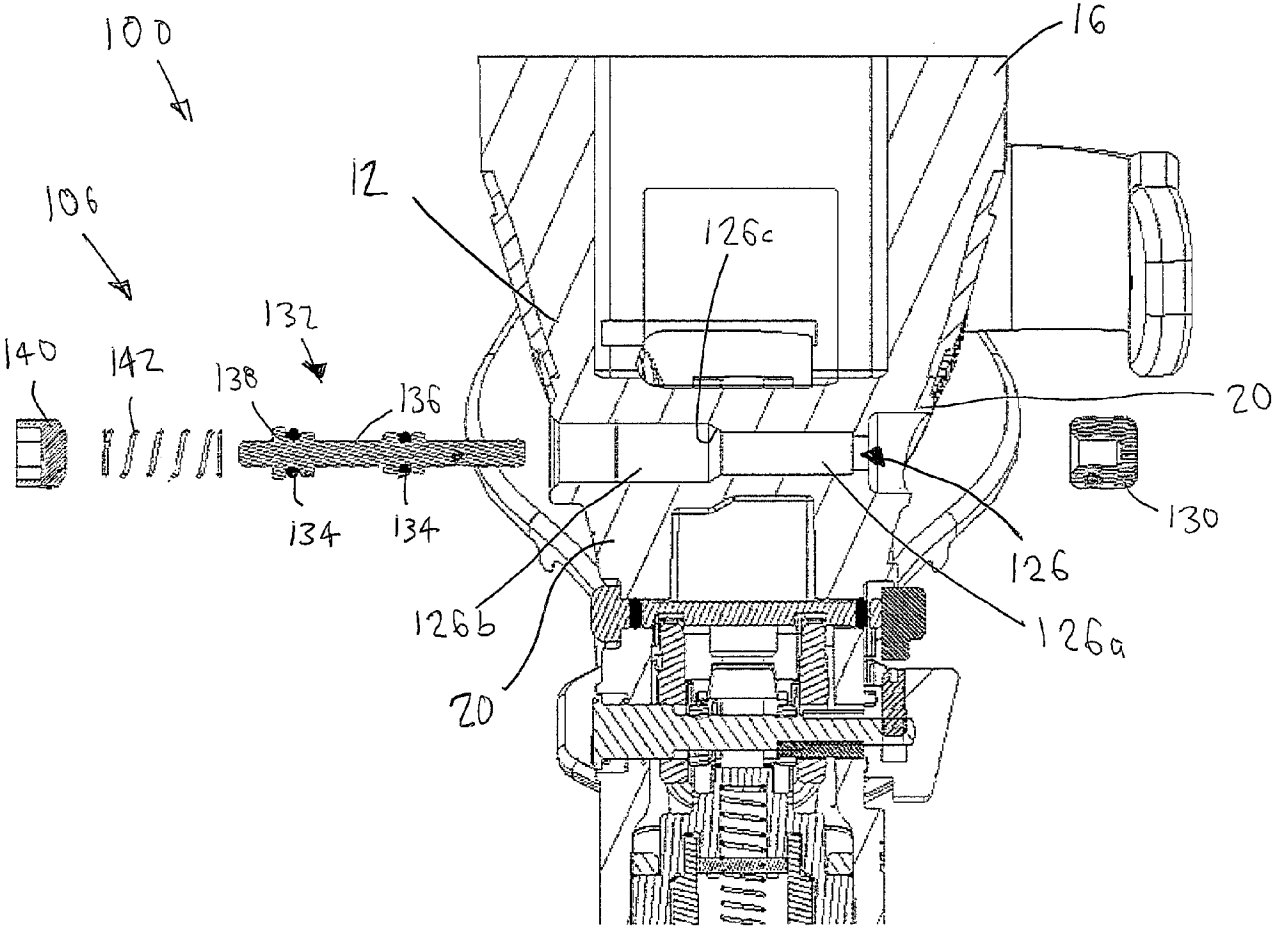
FIG. 4 illustrates a partial cross-sectional view of the fastener driving device of FIG. 1, with the actuator of the dust blower of FIG. 3 in exploded view.
Figure 6:
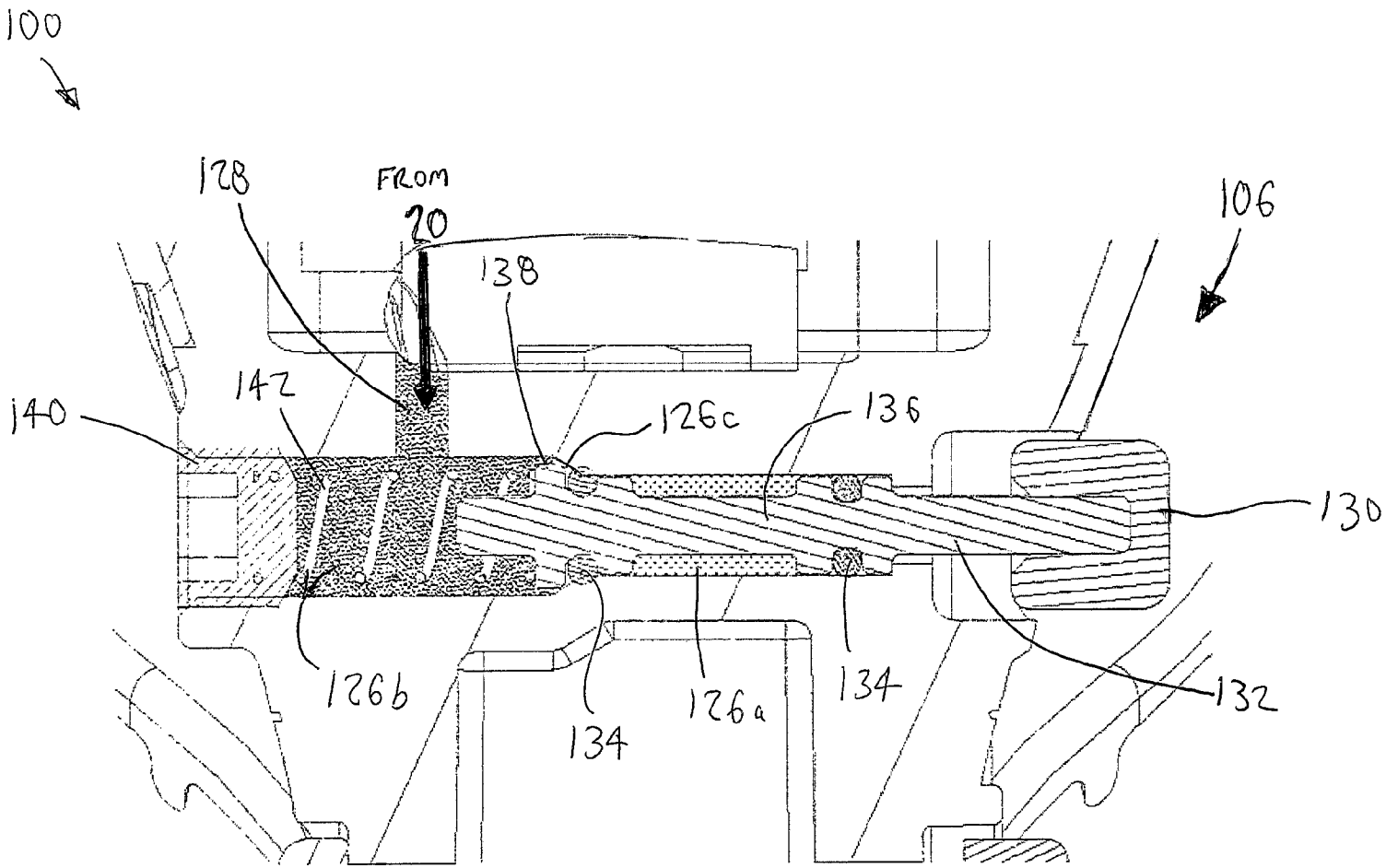
FIG. 6 illustrates a cross-sectional view of the actuator of the dust blower of FIG. 4 with an elongated member of the actuator in a first position.

As illustrated in FIG. 4, the housing 12 of the fastener driving device 10 includes an elongated chamber 126 that extends through the housing 12 and is configured to receive the actuator 106 of the dust blower 100, as discussed in further detail below. Although the elongated chamber 126 is illustrated as being in the handle portion 20 of the housing 12, the elongated chamber 126 may be located in the engine receiving portion 16 of the housing 12. In an embodiment, the elongated chamber 126 may not extend entirely through the housing 12, but instead may be capped off at one end by the housing 12. The elongated chamber 126 generally includes a first portion **126*a* having a surface defined by a first diameter and a second portion 126*b* having a surface defined by a second diameter that is greater than the first diameter. The elongated chamber 126 also includes a transition surface 126*c* in between the surface that defines the first portion 126*a* and the surface that defines the second portion 126*b*. The first portion 126*a* of the elongated chamber 126 is in fluid communication with the passageway 102, as illustrated in FIG. 5, and the second portion 126*b* is in fluid communication with the reservoir 14 via a third passageway 128 that is located between the reservoir 14 and the elongated chamber 126, as generally illustrated in FIG. 6**.

The actuator 106 includes a manually engageable portion 130, an elongated member 132 that is operatively connected to the manually engageable portion 130, and a pair of seals 134 spaced apart along the elongated member 132. The manually engageable portion 130 may be in the form of a push button that is configured to be pushed by a user's thumb or finger, as illustrated in the Figures, and may be attached to one end of the elongated member 132. Any suitable means for attaching the push button to the elongated member 132 may be used, such as a press fit, an adhesive, etc. In another embodiment, the manually engageable portion 30 may be in the form of a rotatable switch or a slide, or any other suitable structure that is configured to allow the user to actuate the actuator 106. The illustrated embodiment is not intended to be limiting in any way.

The elongated member 132 generally includes a first portion 136 configured to be received by the first portion 126*a* of the elongated chamber 126, and a second portion 138 configured to be received by the second portion 126*b* of the elongated chamber 126. As illustrated, the first portion 136 has section that has a smaller diameter than the second portion 138 and is located between the pair of seals 134. The seals 134, which may be o-rings, are configured to engage the inner surface that defines the first portion 126*a* of the elongated chamber 126 when the elongated member 132 is positioned within the chamber 126 and provide a seal between the first portion 126*a* of the elongated chamber 126 and the first portion 136 of the elongated member 132 when the elongated member 132 is in a first position, as illustrated in FIG. 6.

The actuator 106 also includes an end cap 140 and a biasing member 142, which may be a spring, for example a coil spring, that is positioned between the elongated member 132 and the end cap 140. The biasing member 142 is configured to bias the elongated member 132 in the first position, as discussed in further detail below. Any suitable biasing member may be used to bias the elongated member 132. The illustrated embodiment is not intended to be limiting in any way. The end cap 140 may be a set screw that is screwed into the housing 12, as illustrated in FIG. 5, and configured to seal the elongated chamber 126 at one end thereof.

Figure 7:
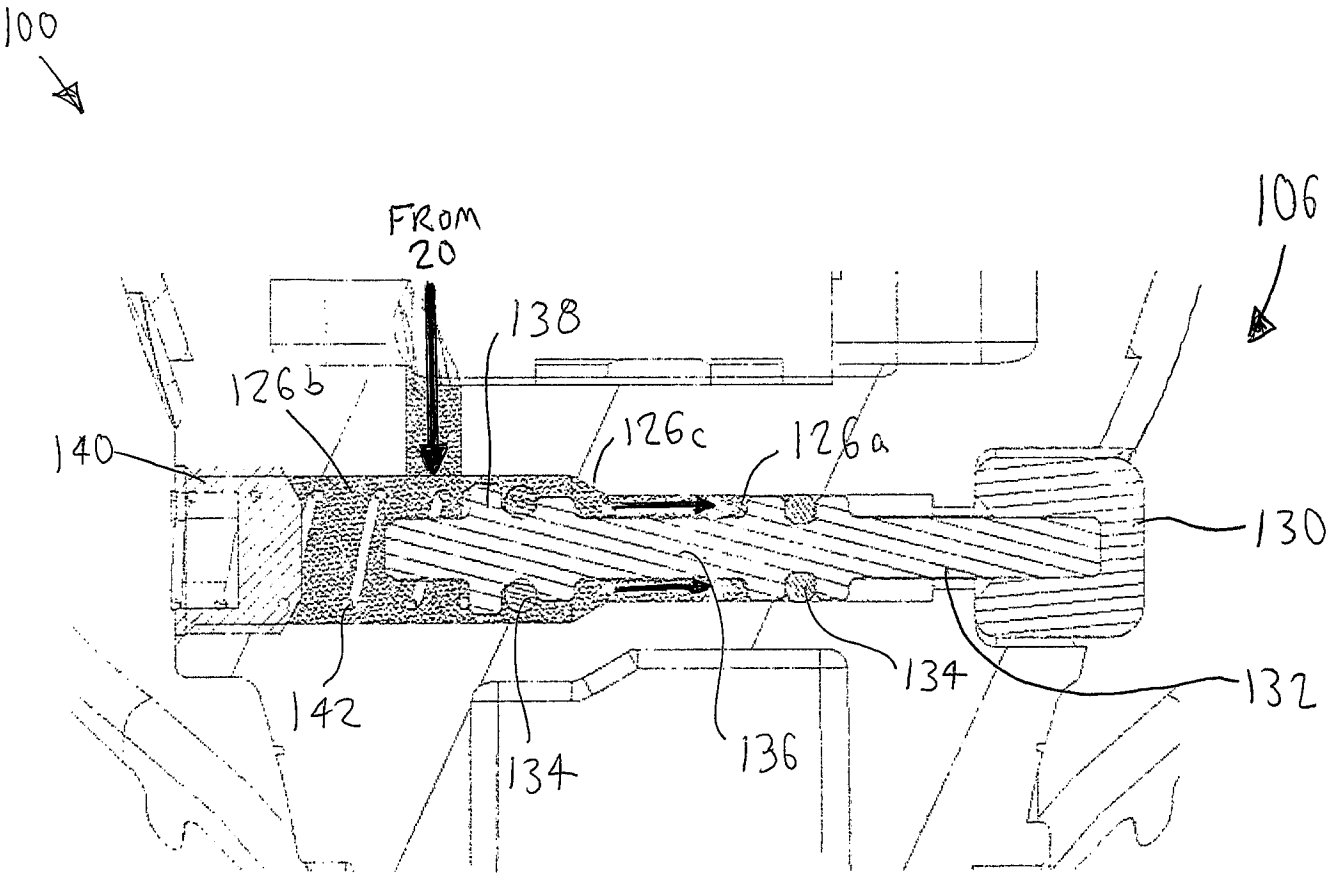
FIG. 7 illustrates the elongated member of the actuator of FIG. 6 in a second position.
Figure 8:
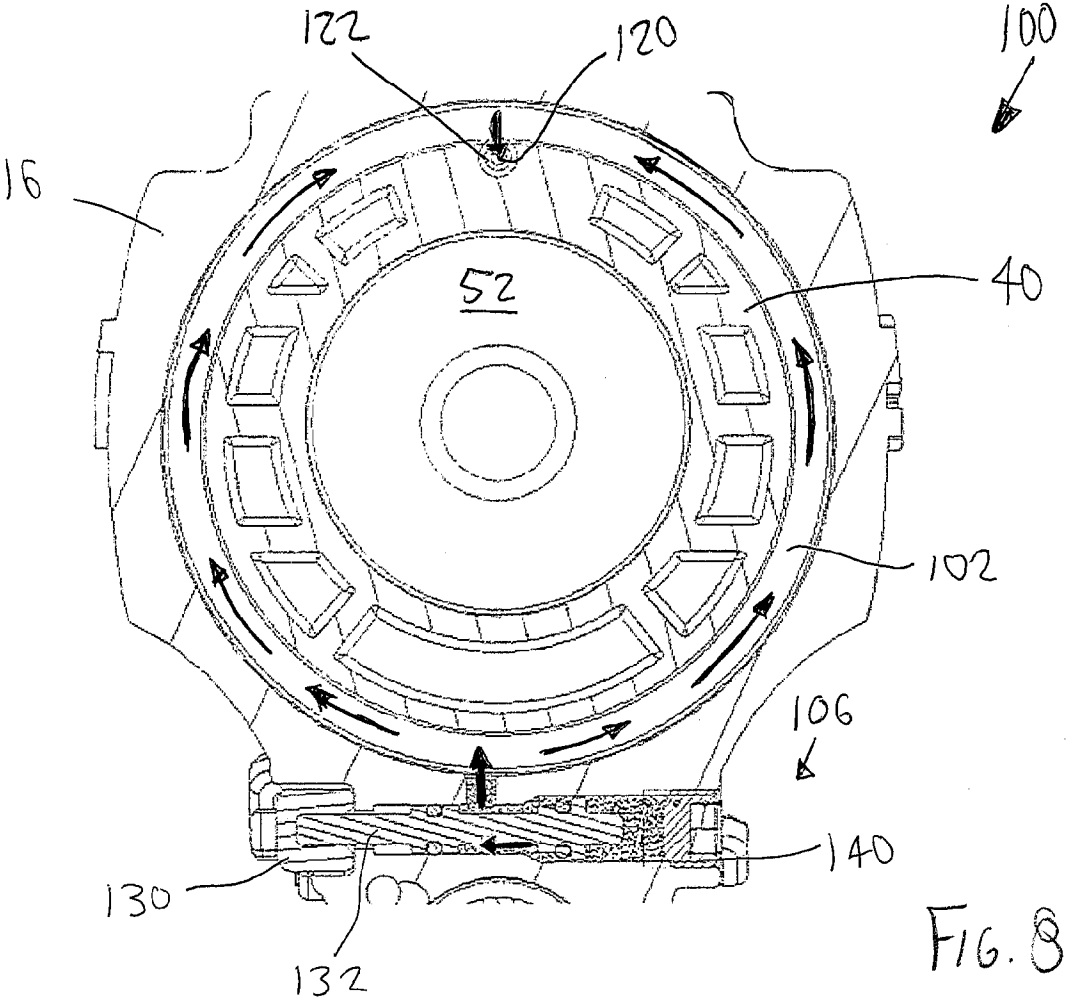
FIG. 8 illustrates the portion of the dust blower of FIG. 5 when the elongated member of the actuator is in the second position.

When the elongated member 132 is in the first position, as illustrated in FIG. 6, the second portion 138 of the elongated member 132 is positioned against the transition surface 126*c* so that second portion 126*b* of the elongated chamber 126 is sealed from the first portion 126*a* of the elongated chamber 126, which prevents pressurized gas from being communicated from the reservoir 14 to the passageway 102 via the chamber 126. When the elongated member 132 is in a second position, as illustrated in FIG. 7, the first portion 136 of the elongated member 132 is partially positioned within the second portion 126*b* of the elongated chamber 126, which allows the pressurized gas from the reservoir 14 to pass through elongated chamber 126, through the passageway 102, and out the outlet 104, as generally illustrated in FIGS. 7-9.

To actuate the dust blower 100 by moving the elongated member 132 from the first position to the second position, the user may use a thumb (or finger) to press the manually engageable portion 130 of the actuator 106 towards the housing 12 and against the bias of the bias member 142, which opens a fluid flow path between the reservoir 14 and the outlet 104, as described above. To stop the flow of the pressurized gas from the reservoir 14 to the outlet 104, the user may take the thumb (or finger) off of the manually engageable portion 130 so that the biasing member 142 may move the elongated member 132 from the second position back to the first position, which will stop the flow of the pressurized gas from the reservoir to the outlet 104.

In the illustrated embodiment, the manually engageable portion 130 of the actuator 106 is located near the trigger 98 of the fastener driving device 10, as illustrated in FIG. 1, which may allow the user to grasp the handle 20 and operate the dust blower 100 and the trigger 98 without having to regrasp the fastener driving device 10. For example, four fingers of the user may grasp the handle 20 while the thumb is used to push the manually engageable portion 130. In an alternative arrangement (not shown), the manually engageable portion can be placed so that it is more convenient for the user's trigger finger or index finger to actuate the manually engageable portion 130 while the other fingers grasp the handle 20. The location of the outlet 104 of the dust blower 100 may allow the user to quickly blow off dust from the workpiece and position the fastener driving device on the workpiece in an operative position with minimal movement of the fastener driving device 10. In operation, the user may clear dust from the workpiece by using a thumb (or finger) to operate the dust blower 100, as described above, before or as the fastener driving device 10 is being positioned at the desired location on the workpiece, and then actuate the trigger valve 66 via the trigger 98 after the fastener driving device 10 is positioned at the desired location on the workpiece and the contact arm 68 is depressed against the workpiece.

While specific embodiments of the invention have been described above, it will be appreciated that the invention may be practiced otherwise than as described. The descriptions above are intended to be illustrative, not limiting. Thus, it will be apparent to one skilled in the art that modifications may be made to the invention as described without departing from the scope of the claims set out below.

What is claimed is:

1. A fastener driving device comprising:
- a housing having an engine receiving portion and a handle portion;
- a drive engine located in the engine receiving portion, the drive engine comprising a cylinder and a piston reciprocally mounted within the cylinder, the piston comprising a driver configured to move along a drive axis to drive a fastener during a drive stroke;
- a reservoir at least partially located in the handle portion, the reservoir configured to receive a gas having a pressure greater than atmospheric pressure, the reservoir being in fluid communication with the drive engine;
- a trigger configured to operate the drive engine; and
- a dust blower configured to allow gas in the reservoir to be selectively communicated to atmosphere through an outlet in the engine receiving portion of the housing, the dust blower comprising
  - a passageway extending from the reservoir to the outlet in the engine receiving portion of the housing, the passageway at least partially circumnavigating the cylinder of the drive engine, and
  - an actuator configured to selectively open and close the passageway so that when the passageway is open, gas from the reservoir is communicated from the reservoir to the outlet, and when the passageway is closed, the gas from the reservoir is not communicated from the reservoir to the outlet.

2. The fastener driving device according to claim 1, wherein the actuator is located on the handle portion.

3. The fastener driving device according to claim 2, wherein the actuator is located near the trigger.

4. The fastener driving device according to claim 1, wherein the housing comprises an elongated chamber, and wherein the actuator comprises an elongated member slidingly received by the elongated chamber, a first seal surrounding a circumference of the elongated member, and a second seal surrounding the circumference of the elongated member and spaced from the first seal along the elongated member, wherein when the elongated member is in a first position, the first seal contacts an inner surface of the elongated chamber to block the passageway, and wherein when the elongated member is in a second position, the first seal does not contact the inner surface of the elongated chamber to open the passageway and allow the gas from the reservoir to flow through the passageway to the outlet.

5. The fastener driving device according to claim 4, wherein the actuator further comprising a biasing member configured to bias the elongated member in the first position.

6. The fastener driving device according to claim 5, wherein the biasing member is a coil spring.

7. The fastener driving device according to claim 5, wherein the elongated chamber comprises a first surface defined by a first diameter, a second surface defined by a second diameter that is larger than the first diameter, and transition surface in between the first surface and the second surface, and wherein the elongated member comprises a portion configured to engage the biasing member on a first side and to engage the transition surface on a second side that is opposite the first side to hold the elongated member in the first position.

8. The fastener driving device according to claim 7, wherein the first seal is located adjacent the second side and configured to engage the transition surface when the elongated member is in the first position.

9. The fastener driving device according to claim 5, wherein the actuator further comprises a push button connected to one end of elongated member, the push button being configured to receive a thumb or finger of a user of the fastener driving device to enable the user to move the elongated member against the bias of the biasing member to move the elongated member from the first position to the second position.

* * * * *